US009664424B2

(12) United States Patent
Hinde et al.

(10) Patent No.: US 9,664,424 B2
(45) Date of Patent: May 30, 2017

(54) CASCADE REFRIGERATION SYSTEM WITH MODULAR AMMONIA CHILLER UNITS

(71) Applicants: Hill Phoenix, Inc., Conyers, GA (US); Allen Phillips, Atlanta, GA (US)

(72) Inventors: David K. Hinde, Atlanta, GA (US); John D. Bittner, Bethlehem, GA (US); Shitong Zha, Conyers, GA (US); Joe T. Wilkerson, Jr., Covington, GA (US)

(73) Assignee: Hill Phoenix, Inc., Conyers, GA (US)

( * ) Notice: Subject to any disclaimer, the term of this patent is extended or adjusted under 35 U.S.C. 154(b) by 1199 days.

(21) Appl. No.: 13/706,122

(22) Filed: Dec. 5, 2012

(65) Prior Publication Data

US 2013/0091891 A1 Apr. 18, 2013

Related U.S. Application Data

(63) Continuation-in-part of application No. 12/948,442, filed on Nov. 17, 2010, now Pat. No. 9,541,311.

(51) Int. Cl.
*F25B 43/02* (2006.01)
*F25B 7/00* (2006.01)
(Continued)

(52) U.S. Cl.
CPC ..... *F25B 43/02* (2013.01); *F25B 7/00* (2013.01); *F25B 9/002* (2013.01); *F25B 25/005* (2013.01);
(Continued)

(58) Field of Classification Search
CPC ..... F25B 7/00; F25B 25/005; F25B 31/004; F25B 43/02
(Continued)

(56) References Cited

U.S. PATENT DOCUMENTS 2,661,836 A 12/1953 Jewell
2,779,170 A * 1/1957 Solley, Jr. ..... F25B 39/02 62/471
(Continued)

FOREIGN PATENT DOCUMENTS

EP 0 602 911 6/1994
EP 0 675 331 10/1995
(Continued)

OTHER PUBLICATIONS

Annex to Form PCT/ISA/206 Communication Relating to the Results of the Partial International Search, Application No. PCT/US03/34606, 2 pages.

*Primary Examiner* — Jonathan Bradford
(74) *Attorney, Agent, or Firm* — Foley & Lardner LLP

(57) ABSTRACT

A cascade refrigeration system including an upper portion having at least one modular chiller unit that provides cooling to at least one of a low temperature subsystem having a plurality of low temperature loads, and a medium temperature subsystem having a plurality of medium temperature loads. The modular chiller unit includes a refrigerant circuit having at least a compressor, a condenser, an expansion device, and an evaporator. An ammonia refrigerant which may have entrained oil from the compressor circulates within the refrigerant circuit. An oil recycling circuit removes some oil from the ammonia refrigerant for return to the compressor. An oil pot collects oil accumulated in the evaporator and an oil return line drains oil from the oil pot to an ammonia accumulator or directly to the compressor.

16 Claims, 6 Drawing Sheets

(51) Int. Cl.
*F25B 9/00* (2006.01)
*F25B 25/00* (2006.01)
*F25B 31/00* (2006.01)

(52) U.S. Cl.
CPC ..... *F25B 31/004* (2013.01); *F25B 2600/21* (2013.01)

(58) Field of Classification Search
USPC ..... 62/175, 335
See application file for complete search history.

(56) References Cited

U.S. PATENT DOCUMENTS 2,797,068 A 6/1957 McFarlan
2,900,801 A 8/1959 Honnegger
3,102,399 A 9/1963 Meckler
4,014,182 A 3/1977 Granryd
4,033,740 A 7/1977 Meckler
4,122,686 A 10/1978 Lindahl et al.
4,303,090 A * 12/1981 Mayer ..... F25B 31/004 137/114
4,429,547 A 2/1984 Granryd
4,484,449 A 11/1984 Muench
4,557,115 A * 12/1985 Nakamura ..... F25B 13/00 62/156
4,575,595 A 3/1986 Gill
4,750,335 A 6/1988 Wallace et al.
4,765,150 A 8/1988 Persem
4,984,435 A 1/1991 Seino et al.
RE33,620 E 6/1991 Persem
5,042,262 A 8/1991 Gyger et al.
5,046,320 A 9/1991 Loose et al.
5,048,303 A 9/1991 Campbell et al.
5,170,639 A 12/1992 Datta
5,212,965 A 5/1993 Datta
5,217,064 A 6/1993 Kellow et al.
5,228,581 A 7/1993 Palladino et al.
5,335,508 A 8/1994 Tippmann
5,351,498 A 10/1994 Takahashi et al.
5,386,709 A 2/1995 Aaron
5,426,952 A 6/1995 Bessler
5,431,547 A 7/1995 Boyko
D361,226 S 8/1995 Jones et al.
D361,227 S 8/1995 Jones et al.
5,438,846 A 8/1995 Datta
5,475,987 A 12/1995 McGovern
5,544,496 A 8/1996 Stoll et al.
5,596,878 A 1/1997 Hanson et al.
5,634,345 A * 6/1997 Alsenz ..... F04B 39/0207 184/7.4
5,683,229 A 11/1997 Stoll et al.
5,688,433 A 11/1997 Kasahara et al.
5,743,110 A 4/1998 Laude-Bousquet
6,067,814 A 5/2000 Imeland
6,089,033 A 7/2000 Dube
6,094,925 A 8/2000 Arshansky et al.
6,112,532 A 9/2000 Bakken
6,148,634 A 11/2000 Sherwood
6,170,270 B1 1/2001 Arshansky et al.
RE37,054 E 2/2001 Sherwood
6,185,951 B1 2/2001 Lane et al.
6,202,425 B1 3/2001 Arshansky et al.
6,205,795 B1 3/2001 Backman et al.
6,212,898 B1 4/2001 Ueno et al.
6,233,967 B1 5/2001 Seewald et al.
6,263,694 B1 * 7/2001 Boyko ..... F25B 31/004 62/195
6,286,322 B1 9/2001 Vogel et al.
6,349,564 B1 2/2002 Lingelbach et al.
6,385,980 B1 5/2002 Sienel
6,393,858 B1 5/2002 Mezaki et al.
6,405,558 B1 6/2002 Sheehan
6,418,735 B1 7/2002 Sienel
6,449,967 B1 9/2002 Dube
6,463,757 B1 10/2002 Dickson et al.
6,467,279 B1 10/2002 Backman et al.
6,481,231 B2 11/2002 Vogel et al.
6,494,054 B1 12/2002 Wong et al.
6,502,412 B1 1/2003 Dube
6,550,258 B1 * 4/2003 Shoulders ..... F04C 28/06 62/472
6,568,195 B2 5/2003 Kaimai et al.
6,574,978 B2 6/2003 Flynn et al.
6,631,621 B2 10/2003 VanderWoude et al.
6,658,867 B1 12/2003 Taras et al.
6,672,087 B1 1/2004 Taras et al.
6,708,511 B2 3/2004 Martin
6,722,145 B2 4/2004 Podtchereniaev et al.
6,745,588 B2 6/2004 Kahler
6,775,993 B2 8/2004 Dube
6,843,065 B2 1/2005 Flynn
6,883,343 B2 4/2005 Lane et al.
6,889,514 B2 5/2005 Lane et al.
6,889,518 B2 5/2005 Lane et al.
6,915,652 B2 7/2005 Lane et al.
6,951,117 B1 10/2005 Wightman
6,968,708 B2 11/2005 Gopalnarayanan et al.
6,981,385 B2 1/2006 Arshansky et al.
6,983,613 B2 1/2006 Dube
7,000,413 B2 2/2006 Chen et al.
7,065,979 B2 6/2006 Arshansky et al.
7,121,104 B2 10/2006 Howington et al.
7,159,413 B2 1/2007 Dail
7,275,376 B2 10/2007 Swofford et al.
RE39,924 E 11/2007 Dube
7,357,000 B2 4/2008 Schwichtenberg et al.
7,374,186 B2 5/2008 Mason et al.
7,424,807 B2 9/2008 Sienel
7,610,766 B2 11/2009 Dube
7,628,027 B2 12/2009 Shapiro
7,913,506 B2 3/2011 Bittner et al.
2001/0023594 A1 9/2001 Ives
2001/0027663 A1 10/2001 Zeigler et al.
2002/0040587 A1 4/2002 Flynn
2002/0066286 A1 6/2002 Alsenz
2003/0019219 A1 1/2003 Viegas et al.
2003/0029179 A1 2/2003 Vander Woude et al.
2004/0016245 A1 * 1/2004 Pierson ..... F01K 23/10 62/175
2004/0159111 A1 8/2004 Takegami et al.
2005/0044879 A1 * 3/2005 Ayub ..... F25B 43/02 62/470
2007/0000262 A1 * 1/2007 Ikegami ..... F25B 41/00 62/170
2007/0056312 A1 3/2007 Kobayashi
2007/0234753 A1 * 10/2007 Nemoto ..... F25B 25/005 62/335
2007/0245752 A1 10/2007 Honda
2007/0289326 A1 12/2007 Nishikawa et al.
2008/0148751 A1 6/2008 Swofford
2008/0209921 A1 9/2008 Swofford
2008/0289350 A1 11/2008 Shapiro
2009/0000321 A1 1/2009 Hall
2009/0025404 A1 1/2009 Allen
2009/0107159 A1 4/2009 Mann et al.
2009/0107170 A1 * 4/2009 Yoon ..... F25B 31/004 62/468
2009/0120108 A1 5/2009 Heinbokel et al.
2009/0120117 A1 5/2009 Martin et al.
2009/0158612 A1 6/2009 Thilly et al.
2009/0260381 A1 * 10/2009 Bittner ..... F25B 7/00 62/255
2009/0260389 A1 10/2009 Dube
2009/0272128 A1 11/2009 Ali
2009/0293517 A1 12/2009 Bittner
2009/0301112 A1 12/2009 Nelson
2010/0023171 A1 1/2010 Bittner et al.
2010/0031697 A1 2/2010 Hinde et al.
2010/0071391 A1 3/2010 Lifson et al.
2010/0077777 A1 4/2010 Lifson et al.
2010/0115975 A1 5/2010 Mitra et al.

(56) References Cited

U.S. PATENT DOCUMENTS

| | | | | |
|---|---|---|---|---|
| 2010/0132382 | A1* | 6/2010 | Rini | F04B 53/08 62/84 |
| 2010/0132399 | A1 | 6/2010 | Mitra et al. | |
| 2010/0199707 | A1 | 8/2010 | Pearson | |
| 2010/0199715 | A1 | 8/2010 | Lifson et al. | |
| 2010/0205984 | A1 | 8/2010 | Gu et al. | |
| 2010/0212350 | A1 | 8/2010 | Gu et al. | |
| 2011/0138823 | A1 | 6/2011 | Troutman et al. | |
| 2011/0185757 | A1 | 8/2011 | Bittner et al. | |
| 2012/0117996 | A1 | 5/2012 | Hinde et al. | |
| 2013/0186128 | A1 | 7/2013 | Kim et al. | |

FOREIGN PATENT DOCUMENTS

| | | |
|---|---|---|
| EP | 1 134 514 | 9/2001 |
| EP | 1 139 041 | 10/2001 |
| WO | WO 2009/158612 | 12/2009 |

* cited by examiner

CASCADE REFRIGERATION SYSTEM WITH MODULAR AMMONIA CHILLER UNITS

CROSS-REFERENCE TO RELATED APPLICATIONS

The present application is a continuation-in-part of U.S. application Ser. No. 12/948,442 filed on Nov. 17, 2010, the complete disclosure of which is incorporated by reference herein.

FIELD

The present invention relates to a cascade refrigeration system having an upper portion that uses a modular chiller unit having ammonia as a refrigerant to provide condenser cooling for a refrigerant in a low temperature subsystem (for cooling low temperature loads) and/or for chilling a liquid that is circulated through a medium temperature subsystem (for cooling medium temperature loads). The present invention relates more particularly to a cascade refrigeration system having a critically-charged modular chiller unit that uses a sufficiently small charge of ammonia to minimize potential toxicity and flammability hazards. The present invention also relates more particularly to a modular ammonia cascade refrigeration system that uses a soluble or non-soluble oil with a particular oil control system mixed with the ammonia refrigerant charge. The present invention relates more particularly still to a modular ammonia cascade refrigeration system that uses an oil siphon arrangement to ensure positive return of oil from an evaporator of the modular ammonia chiller unit.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Refrigeration systems typically include a refrigerant that circulates through a series of components in a closed system to maintain a cold region (e.g., a region with a temperature below the temperature of the surroundings). One exemplary refrigeration system includes a direct-expansion vapor-compression refrigeration system including a compressor. Such a refrigeration system may be used, for example, to maintain a desired low temperature within a low temperature controlled storage device, such as a refrigerated display case, coolers, freezers, etc. in a low temperature subsystem of the refrigeration system. Another exemplary refrigeration system includes a chilled liquid coolant circulated by a pump to maintain a desired medium temperature within a medium temperature storage device in a medium temperature subsystem of the refrigeration system. The low and/or medium temperature subsystems may each receive cooling from one or more chiller units in a cascade arrangement. The chiller units circulate a refrigerant through a closed-loop refrigeration cycle that includes an evaporator which provides cooling to the low temperature subsystem (e.g. as a condenser) and/or the medium temperature subsystem (e.g. as a chiller).

Accordingly, it would be desirable to provide a cascade refrigeration system having one or more modular chiller units capable of using ammonia as a refrigerant for providing condenser cooling in a low temperature subsystem of the refrigeration system, and/or for chilling a liquid coolant for circulation through a medium temperature subsystem of the refrigeration system.

SUMMARY

One embodiment of the present disclosure relates to a cascade refrigeration system that includes an upper portion having at least one modular chiller unit that provides cooling to at least one low temperature subsystem having a plurality of low temperature loads, and a medium temperature subsystem having a plurality of medium temperature loads. The modular chiller unit includes a refrigerant circuit having at least a compressor, a condenser, an expansion device, and an evaporator. The modular chiller unit also includes an ammonia refrigerant configured for circulation within the refrigerant circuit, an ammonia refrigerant accumulator configured to receive the ammonia refrigerant from the evaporator, an oil recycling circuit having an oil separator, an oil filter, and oil pressure regulator, and an oil float, and an oil return line configured to reduce oil collection in the evaporator and to remove any collected oil from the evaporator. The modular chiller unit may also include an oil collection vessel ("oil pot", etc.) that uses warmed coolant (e.g. glycol, etc.) to heat the oil being returned from the evaporator in order to boil-off entrained ammonia refrigerant prior to returning the oil to the ammonia refrigerant accumulator.

Another embodiment of the present disclosure relates to a modular ammonia chiller unit for a refrigeration system, including a refrigerant circuit having at least a compressor, a condenser, an expansion device, an evaporator, an ammonia refrigerant, an oil recycling circuit having an oil separator, an oil filter, an oil pressure regulator, and an oil reservoir, and an oil return line.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1A:
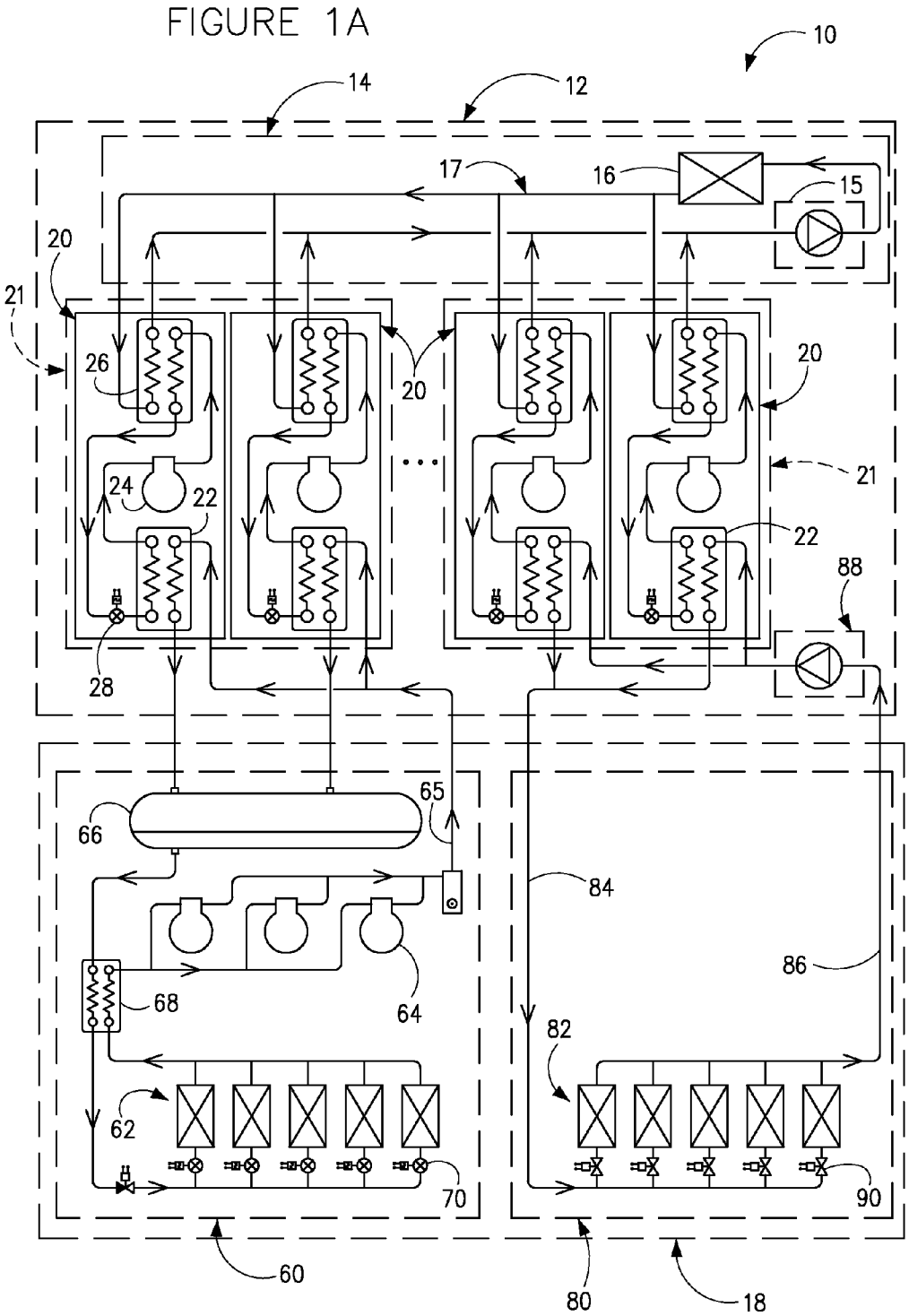
FIG. 1A is a schematic diagram of a cascade refrigeration system having modular ammonia chiller units according to an exemplary embodiment.
Figure 1B:
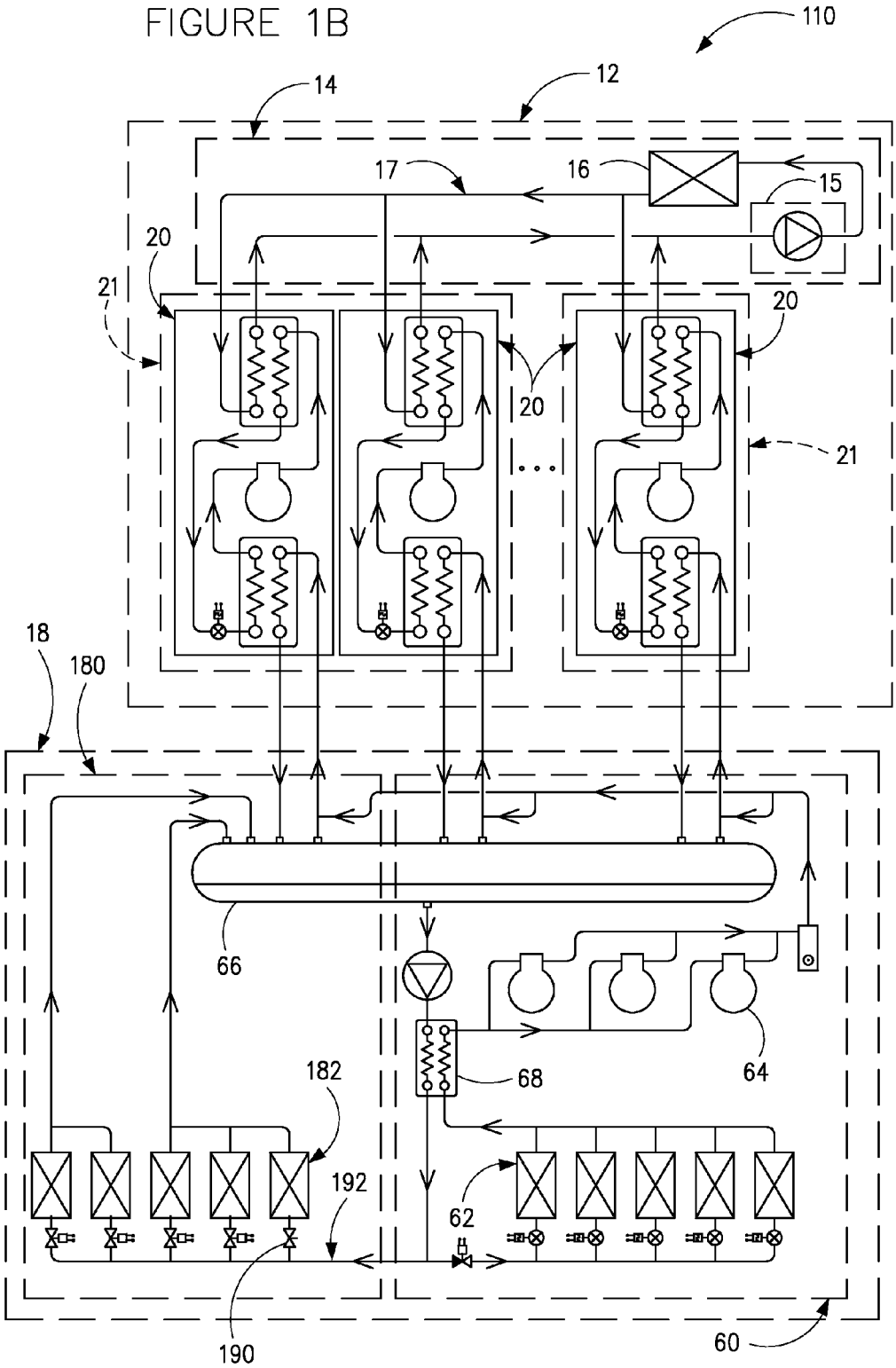
FIG. 1B is a schematic diagram of a cascade refrigeration system having modular ammonia chiller units according to an exemplary embodiment.

Referring to FIGS. 1A and 1B, a cascade refrigeration system 10 is shown according to an exemplary embodiment.

The refrigeration system 10 of FIG. 1A is a cascade system that includes several subsystems or loops. According to an exemplary embodiment, the cascade refrigeration system 10, comprises an 'upper' portion 12 that includes one or more modular ammonia chiller unit 20 that provide cooling to a 'lower' portion 18 having a medium temperature subsystem 80 for circulating a medium temperature coolant (e.g. water, glycol, water-glycol mixture, etc.) and a low temperature subsystem 60 for circulating a low temperature refrigerant (such as a hydrofluorocarbon (HFC) refrigerant, carbon dioxide (CO2), etc.).

The terms "low temperature" and "medium temperature" are used herein for convenience to differentiate between two subsystems of refrigeration system 10. Medium temperature subsystem 80 maintains one or more loads, such as cases 82 (e.g. refrigerator cases or other cooled areas) at a temperature lower than the ambient temperature but higher than low temperature cases 62. Low temperature subsystem 60 maintains one or more loads, such as cases 62 (e.g. freezer display cases or other cooled areas) at a temperature lower than the medium temperature cases. According to one exemplary embodiment, medium temperature cases 82 may be maintained at a temperature of approximately 20° F. and low temperature cases 62 may be maintained at a temperature of approximately minus (−) 20° F. Although only two subsystems are shown in the exemplary embodiments described herein, according to other exemplary embodiments, refrigeration system 10 may include more subsystems that may be selectively cooled in a cascade arrangement or other cooling arrangement.

An upper portion (e.g., the upper cascade portion 12) of the refrigeration system 10 includes one or more (shown by way of example as four) modular ammonia chiller units 20, that receive cooling from a cooling loop 14 having a pump 15, and one or more heat exchangers 16, such as an outdoor fluid cooler or outdoor cooling tower for dissipating heat to the exterior or outside environment. Outdoor fluid cooler 16 cools a coolant (e.g., water, etc.) that is circulated by pump 15 through cooling loop 17 to remove heat from the modular ammonia chiller units 20.

Figure 2A:
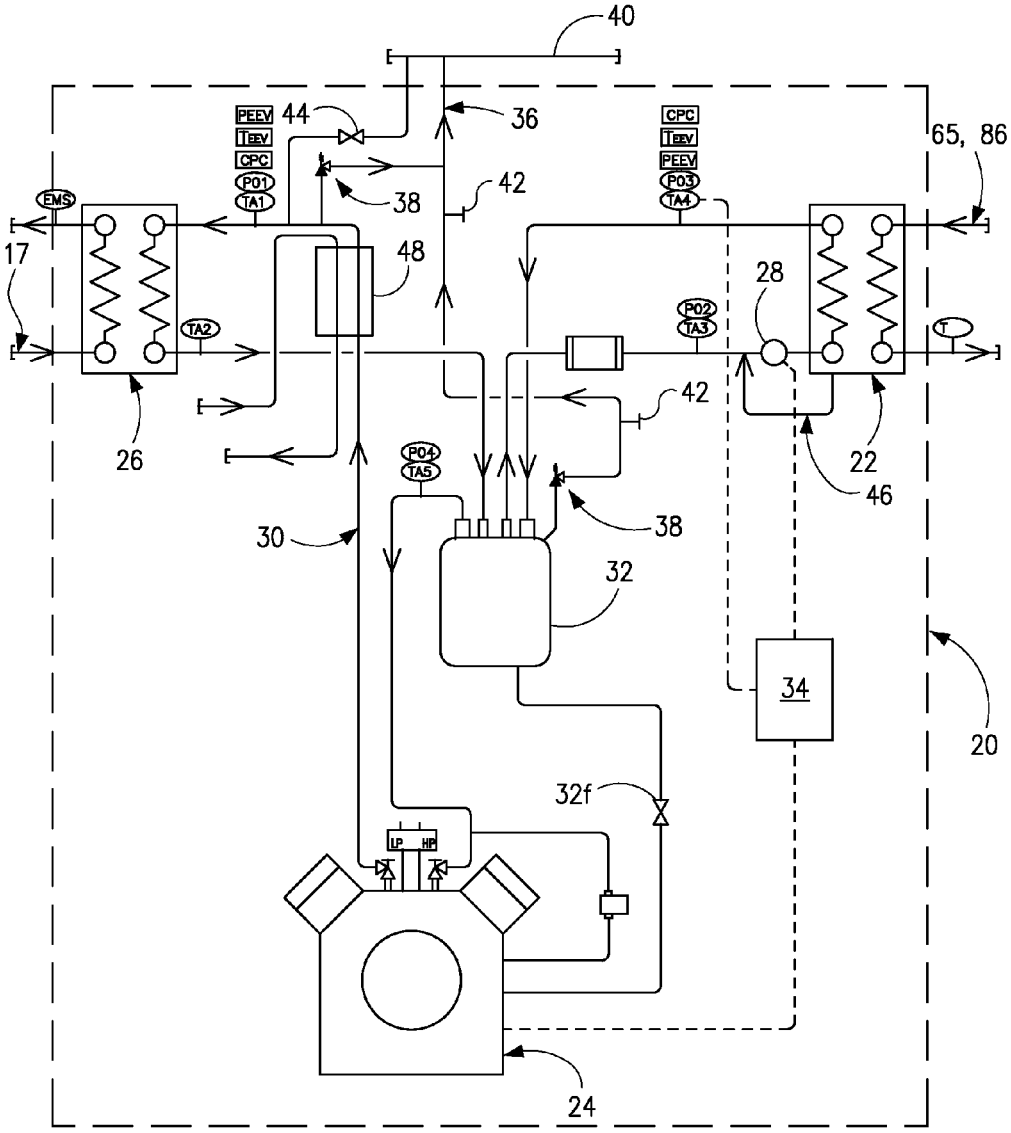
FIG. 2A is a schematic diagram of a modular ammonia chiller unit for the refrigeration system of FIG. 1 according to one exemplary embodiment.
Figure 2B:
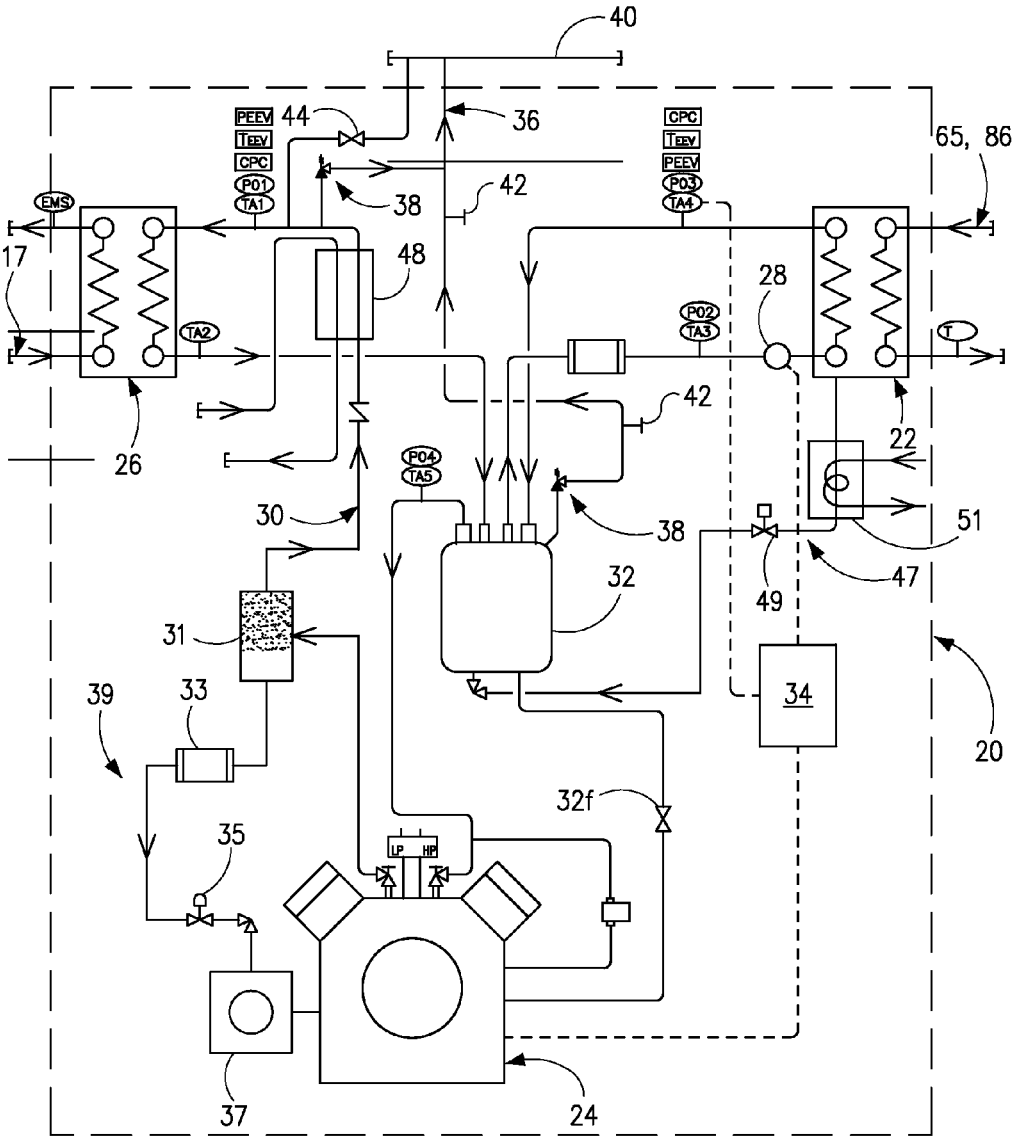
FIG. 2B is a schematic diagram of a modular ammonia chiller unit for the refrigeration system of FIG. 1, including an oil management system and components, according to an exemplary embodiment.

The ammonia chiller unit 20 is shown in more detail in FIGS. 2A and 2B, according to two exemplary embodiments. In both embodiments, chiller unit 20 includes a critical charge of an ammonia refrigerant that is circulated through a vapor-compression refrigeration cycle including a first heat exchanger 22, a compressor 24, a second heat exchanger 26, and an expansion valve 28. In the first heat exchanger 22 (e.g. the evaporator, etc.), the ammonia refrigerant absorbs heat from an associated load such as the compressed hot gas refrigerant in line 65 from the low temperature subsystem 60, or from the circulating medium temperature liquid coolant in return header 86 from the medium temperature subsystem 80. In the second heat exchanger 26 (e.g. condenser, etc.), the refrigerant transfers (i.e. gives up) heat to a coolant (e.g. water circulated through cooling loop 17 by pump 15). The use of a water-cooled condenser is intended to maximize heat transfer from the ammonia refrigerant so that a minimum amount or charge of ammonia is required to realize the intended heat transfer capacity of the chiller unit 20. The coolant is circulated through heat exchanger 16 (which may be a fan-coil unit or the like, etc.) for discharging the heat to the atmosphere.

According to one alternative embodiment, the heat exchanger 26 (condenser) in the modular ammonia chiller unit 20 may be an air-cooled heat exchanger. For example, the air-cooled heat exchanger may be a microchannel type heat exchanger. According to another alternative embodiment, the air-cooled microchannel condenser may further include an evaporative component (such as water spray/baffles, etc.) to further enhance heat transfer of the air-cooled microchannel condenser. According to another embodiment, heat exchanger 16 in the water circulation loop 17 may be (or otherwise include) any of a wide variety of heat reclamation devices, such as may be associated with a facility where system 10 is installed. According to an exemplary embodiment, the term 'critically charged' is understood to mean a minimally sufficient amount of ammonia refrigerant necessary to accomplish the intended heat removal capacity for the chiller unit, without an excess amount of refrigerant (such as might be accommodated in a receiver of a non-critically charged system or device).

Referring further to FIG. 1A, the low temperature subsystem 60 includes a closed-loop circuit circulating a refrigerant (e.g. CO2, HFC, etc.) through one or more low temperature cases 62 (e.g., refrigerated display cases, freezers, etc.), one or more compressors 64, the first heat exchanger 22 of the modular ammonia chiller unit(s) 20 (which serves as a condenser for the hot gas refrigerant from the compressors 64), a receiver 66 (for receiving a supply of condensed liquid refrigerant from the first heat exchanger 22 of the modular ammonia chiller(s) 20, one or more suction line heat exchangers 68, and suitable valves, such as expansion valves 70. Compressors 64 circulates the refrigerant through the low temperature subsystem 60 to maintain cases 62 at a relatively constant low temperature. The refrigerant is separated into liquid and gaseous portions in receiver 66. Liquid refrigerant exits the receiver 66 and is directed to valves 70, which may be an expansion valve for expanding the refrigerant into a low temperature saturated vapor for removing heat from low temperature cases 62, and is then returned to the suction of compressors 64.

Referring further to FIG. 1A, the medium temperature subsystem 80 includes a closed-loop circuit for circulating a chilled liquid coolant (e.g. glycol-water mixture, etc.) through one or more medium temperature cases 82 (e.g., refrigerated display cases, etc.), a supply header 84, a return header 86, a pump 88, and the first heat exchanger 22 of the modular ammonia chiller units 20 (which serves as a chiller for the chilled liquid coolant), and suitable valves 90 for controlling the flow of the chilled liquid coolant through the medium temperature loads of the medium temperature subsystem.

Referring to FIG. 1B, a cascade refrigeration system 110 is shown according to an alternative embodiment, where the medium temperature subsystem 180 may comprise a liquid CO2 branch line 192 from the low temperature subsystem 60, where liquid CO2 is admitted directly into the heat exchangers of the medium temperature loads 182 through a valve 190 (e.g. solenoid valve, etc.). The liquid CO2 typically becomes partially vaporized as it received heat from the medium temperature loads 182 and is then directed back to the receiver 66, where it may then be condensed and cooled by one or more of the modular ammonia chiller units 20.

Referring further to FIG. 2A, the modular ammonia chiller units 20 are shown in further detail, according to an exemplary embodiment. In this embodiment, chiller units 20 have a closed loop circuit 30 that defines an ammonia refrigerant flow path that includes compressor 24, condenser 26, an ammonia accumulator 32, evaporator 22, an expansion device 28 (such as an electronic expansion valve for expanding liquid ammonia refrigerant to a low temperature saturated vapor and controlling the superheat temperature of the ammonia refrigerant exiting the evaporator), and a control device 34.

Notably, in order to provide a chiller unit 20 that is less complex, less expensive, and more easily operated, serviced and maintained by technicians that may otherwise be unfamiliar with ammonia refrigerant systems, in exemplary embodiments, the chiller unit 20 may not include oil management components (e.g. piping, valves, controls, oil reservoir, filters, coolers, separators, float-switches, etc.) for providing lubrication to the compressor 24. For instance, in the illustrated embodiment of FIG. 2A, the modular ammonia chiller unit 20 may use a soluble oil, such as a Poly-Alkylene Glycol (PAG) oil or otherwise, that is mixed with the ammonia refrigerant to provide lubrication to the compressor 24. In this embodiment, the soluble oil mixes with the ammonia refrigerant and thus circulates through the closed loop circuit 30 with the ammonia refrigerant to provide compressor lubrication. In some exemplary embodiments, an oil management system is therefore not necessary to provide lubrication to the compressor 24.

Referring further to FIG. 2B, the modular ammonia chiller units 20 are shown in further detail, according to another exemplary embodiment. In this embodiment, chiller units 20 have a closed loop circuit 30 that defines an ammonia refrigerant flow path that includes compressor 24, condenser 26, an ammonia accumulator 32, evaporator 22, an expansion device 28, and a control device 34, similar to the illustrated embodiment of FIG. 2A. However, in the illustrated embodiment of FIG. 2B, the chiller units 20 also include an oil management system 39 for removing oil entrained in the ammonia vapor, and oil that carries through and accumulates in the evaporator. The system reservoir 39 includes upstream components shown as a recycling circuit having an oil separator 31, an oil filter 33, an oil pressure regulator 35, and an oil system reservoir 37. The components of the circuit of system 39 are intended to remove oil from the ammonia refrigerant vapor in the closed loop circuit 30 "near the source" (i.e. the compressor) returning the oil to the compressor 24. Further in the illustrated embodiment of FIG. 2B, the chiller units 20 also include downstream components of the oil management system, shown to include an oil return (e.g. drain, discharge, siphon, etc.) line 47, connecting the evaporator 22 to the ammonia accumulator 32, and including a valve (e.g. solenoid valve) 49. The oil return line 47 is intended to remove accumulated oil from the evaporator 22, routing the oil to the accumulator 32. Coupling the oil return line to the accumulator is intended to permit separation of the oil and any ammonia refrigerant that may also come from the evaporator during the oil-return process. Although the oil return line is shown coupled to the evaporator 22 and to the accumulator 32 (for subsequent separation and return of the oil from the accumulator 32 to the compressor 24), the oil return line may bypass be coupled directly to the compressor or to the upstream components of the oil management system in alternative embodiments.

According to one embodiment, the compressor 24 is a reciprocating, open-drive, direct-drive type compressor. According to other embodiments, other compressor types may be used, and/or additional components may be included, such as sight glasses, vent valves, and instrumentation such as pressure, flow and/or temperature sensors and switches, etc. In the embodiments of FIGS. 2A and 2B, closed loop circuit 30 may also include a vent line 36 with a vent valve or relief valves 38 that are configured to vent the ammonia refrigerant to a header 40 leading to an outdoor location (e.g. above the rooftop of a facility in which the chiller unit is installed, etc.) in the event that venting of the chiller unit 20 is required. Unlike conventional commercial ammonia refrigeration systems, the critical charge nature and the modularity of the chiller unit 20 results in a sufficiently minimal (i.e. substantially reduced) amount of ammonia refrigerant in each chiller unit 20 (e.g. within a range of approximately 5-20 pounds, and more particularly approximately 10 pounds according to one embodiment), so that the ammonia from any one chiller unit 20 may be released to the atmosphere (e.g. at a rooftop location of the facility) at a given time if necessary with minimal or no impact upon flammability or toxicity requirements associated with the locale or facility. Also, since there are no recapture requirements currently associated with ammonia as a refrigerant (as there are with HFC refrigerants), the ease of operation and maintainability of a refrigeration system with the modular ammonia chiller units 20 is further enhanced. According to one embodiment, the modular ammonia chiller units 20 are installed at a rooftop location of the facility and housed within a dedicated enclosure that provides sufficient weather-protection, but is vented (or otherwise non-airtight) to allow any release of ammonia to disperse therefrom (as shown further in FIG. 4).

According to one exemplary embodiment, the modular ammonia chiller units 20 are compact modular chiller units that are critically charged with a suitable amount of ammonia refrigerant, such as (by way of example) approximately 6-10 pounds of ammonia, or more particularly, approximately 8 pounds of ammonia. System 10 may include a multitude of the compact modular ammonia chiller units 20 arranged in parallel as low temperature refrigerant condensing units and/or as medium temperature liquid chillers. The number of compact modular ammonia chiller units 20 may be varied to accommodate various cooling loads associated with a particular commercial refrigeration system. Likewise, the number of medium temperature cases 82 and low temperature cases 62 may be varied.

Figure 4:
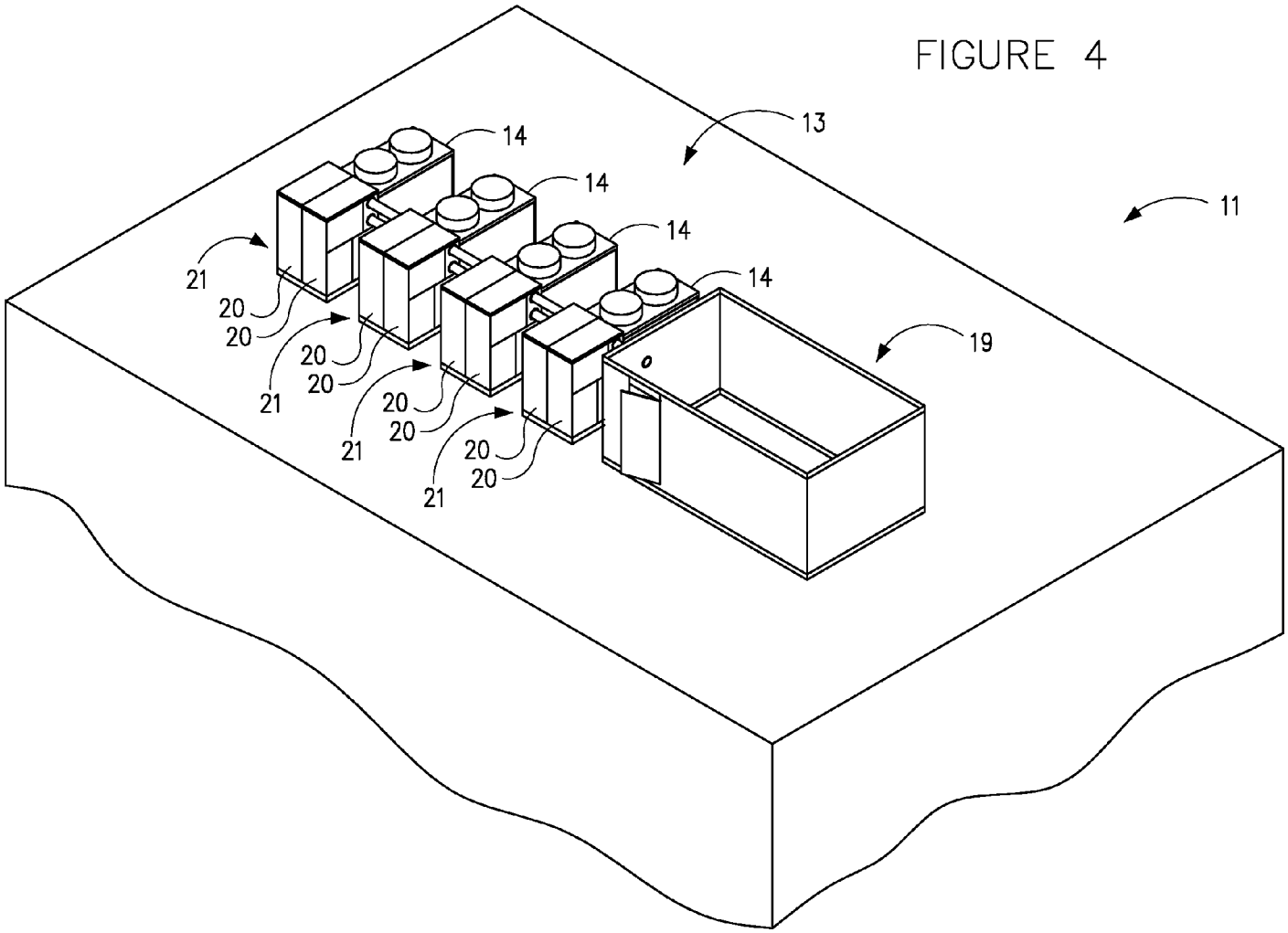
FIG. 4 is a schematic diagram of enclosed modular ammonia chiller units disposed on the rooftop of a facility according to an exemplary embodiment.

Referring to FIG. 4, one embodiment of the commercial cascade refrigeration system having a plurality of compact modular chiller units 20 are shown housed in transportable enclosures for placement on a rooftop 13 (or other suitable location) of a facility 11 is shown. For example, any number of the compact modular ammonia chiller units 20 (shown for example as four groups of two units) that are necessary for a particular commercial refrigeration system design may be pre-mounted to a skid or other platform, and may further by mounted within transportable enclosures 21 for placement at a facility 11 and pre-piped to appropriate supply and return headers, and pre-wired to a suitable electrical connection panel or device, so that the modular chiller units 20 may be shipped as a single unit to a jobsite and quickly and easily connected and powered for use with the lower portion of the cascade commercial refrigeration system 10. In the illustrated embodiment, each transportable enclosure 21 is shown for example to include two modular chiller units 20 housed with the components of an associated water-cooled condensing system 14. The modular chiller units 20 may also be provided with a transportable enclosure such as a mechanical center 19 configured to contain other equipment for the cascade refrigeration system such as control centers, pumps, valves, defrost control panels, and other appropriate equipment.

In order to provide further improved performance of the compact modular ammonia chiller unit 20 of the present disclosure, control device 34 may provide a control scheme for operation of the expansion device 28 to modulate the superheat temperature of the ammonia refrigerant at the exit of the evaporator 22 between a range of approximately 0-10 degrees F. (although other superheat temperature ranges may be used according to other embodiments). The "superheat temperature" as used in the present disclosure is understood to be the temperature of the superheated ammonia vapor refrigerant (in degrees F.) that is above the saturation temperature of the ammonia refrigerant for a particular operating pressure. For example, a superheat temperature of 10 degrees F. is intended to mean the ammonia is superheated to a temperature that is 10 degrees F. above its saturation temperature at the operating pressure. According to one embodiment, the control device 34 provides a signal to the expansion device 28 to operate the chiller unit 20 with a preferred superheat temperature within a range of approximately 6-8 degrees F. to provide for effective performance of the evaporator 22.

According to one embodiment, the control device 34 is (or comprises) a closed-loop proportional-integral-derivative (PID) controller of a type commercially available from Carel USA of Manheim, Pa., and may be programmed using appropriate proportional, integral, and/or derivative settings on the controller that may be preprogrammed, or established empirically during an initial system testing and startup operation to control the superheat setpoint within the desired temperature range. The control settings for the control device 34 may also be set to provide a lower limit for the superheat temperature range, such as a superheat temperature of approximately 1 degree F., according to one embodiment.

According to one embodiment, the control device 34 may be programmed to facilitate return of oil from the evaporator 22 to the compressor 24. For example, the control device 34 may be programmed to periodically (e.g. on a predetermined frequency) turn-off and then restart the compressor 24 as a method for periodically ensuring positive return of any soluble oil that may have accumulated in the evaporator 22 back to the compressor 24. When the compressor 24 is turned-off (e.g. intentionally for oil removal, or intermittently due to loading) the oil return valve 49 can be opened by controller 34 to return oil in the evaporator 22 to the accumulator 32 using the oil return line 47. The frequency of the shutdown-restart operation for each unit 20 may also be based upon a designation of which of the chillers is the "lead" chiller (i.e. the chiller with the most run time, as other of the chillers may be started or shutdown as needed to maintain the desired cooling capacity for the lower portion of the commercial refrigeration system). For commercial refrigeration systems that use multiple modular ammonia chiller units, the shutdown-restart operation and frequency may be established (e.g. sequenced, etc.) so that only one modular ammonia chiller unit is shutdown at any one time. Accordingly, such alternative embodiments are intended to be within the scope of this disclosure.

Referring further to the illustrated embodiment of FIG. 2B, the oil return line 47 of the oil management system 39 for the chiller unit 20 is further described. The compressor 24 of the modular chiller unit 20 uses an oil for lubrication that may become at least partially mixed with (or otherwise entrained in) the ammonia refrigerant as the compressor 24 compresses the refrigerant. According to one embodiment, the oil may be, or include, a Polyalphaolefin (PAO) oil, such as a Mobil Gargoyle Arctic SHC 226 ammonia refrigeration oil that is commercially available from ExxonMobil Corporation of Irving, Tex. The PAO oil may not be soluble within the ammonia refrigerant and a certain amount of oil may be carried in the ammonia refrigerant from the compressor discharge. As a result, managing the PAO oil as it travels through the chiller unit 20 will tend to improve or maintain a desired performance of the system. Some amount of PAO oil may collect in the evaporator 22 as the refrigerant travels through the chiller unit. According to the illustrated embodiment, the chiller unit 20 of FIG. 2B includes an oil return line 47 that is intended to remove excess oil from the evaporator 22, returning the PAO oil to the accumulator 32. The upstream components of the oil management system 39 are also intended to remove oil from the closed loop circuit 30 before it reaches the evaporator 22, by separating the oil from the ammonia refrigerant, then returning the oil to the compressor 24, and thus reducing or minimizing oil collection in the evaporator.

Still referring to FIG. 2B, the upstream components of the oil management system 39 are shown within the chiller unit 20. According to this exemplary embodiment, within the oil management system 39, the oil separator 31 receives a mixture of ammonia refrigerant and oil from the compressor 24. The oil separator 31 is configured to separate and remove most of the oil from the ammonia refrigerant. The removed oil is then filtered in the oil filter 33 to remove sediment and other contaminants from the oil. The pressure regulator 35 is configured to maintain downstream (outlet) oil pressure to a pre-determined pressure in the oil reservoir 37. The oil reservoir 37 and its float switch are configured to operate as an oil "dosing" system in exemplary embodiments, feeding the oil back to the compressor 24 as needed to help maintain proper oil level in the compressor 24.

Referring still to FIG. 2B, the oil separator 31 is intended to remove most of the oil from the refrigerant, sending it back to the compressor 24. However, some oil may remain in the ammonia refrigerant and continue on from the oil separator 31 and through the closed loop circuit 30. Some of the oil remaining in the ammonia refrigerant may accumulate in the evaporator 22 over time. The oil return line 47 is intended to permit the oil that collects in the evaporator 22 to be routed to the accumulator 32 (e.g. via gravity drain or feed), and eventually back to the compressor 24.

In the illustrated embodiment of FIG. 2B, the oil return line 47 includes the oil return solenoid valve 49 and an oil collection vessel 51 (such as an "oil pot" or the like). The oil pot 51 includes an internal tubing coil (or other suitable heat exchange component—not shown) that is configured to receive a heat source (e.g. a warmed fluid such as glycol from a suitable portion of the system, such as a head cooler, etc.). However, according to other embodiments, the heat source may be any suitable heat source, such as heat from the ammonia refrigerant discharged from the compressor, or an electric heater, etc. During normal operation, any oil that is carried-over beyond the upstream components of the oil management system and collects in the evaporator is configured to drain into the oil pot 51 by gravity. The oil pot 51 collects the oil removed from the evaporator 22, where the oil is heated by the heat source in an amount sufficient to vaporize (e.g. boil-off, etc.) most or all of any ammonia refrigerant entrained within the oil. The vaporized ammonia refrigerant then returns with ammonia refrigerant being circulated through evaporator 22 to compressor 24. The solenoid valve 49 is configured to remain in a normally-closed position, but opens periodically (e.g. in response to an appropriate signal from controller 34 when the compressor 24 is turned off and expansion device 28 is closed) to allow oil to travel (e.g. drain) from the oil pot 51 through the oil return line 47 from the evaporator 22 to the accumulator 32. The compressor 24 is configured to turn on and off as needed depending on system loading conditions, as may be determined by the controller 34, or on a pre-established frequency by controller 34 for removing oil from the evaporator. According to the illustrated embodiment, the solenoid valve 49 receives a signal from controller 34 to open when the compressor 24 is turned off, allowing the oil accumulated in the evaporator 22 to travel through the oil return line 47 (e.g. via gravity, suction, siphon, etc.), and to the accumulator 32. From the accumulator 32, the oil may be routed back to the suction of the compressor 24 to assist in maintaining the proper oil level in the compressor.

Figure 3:
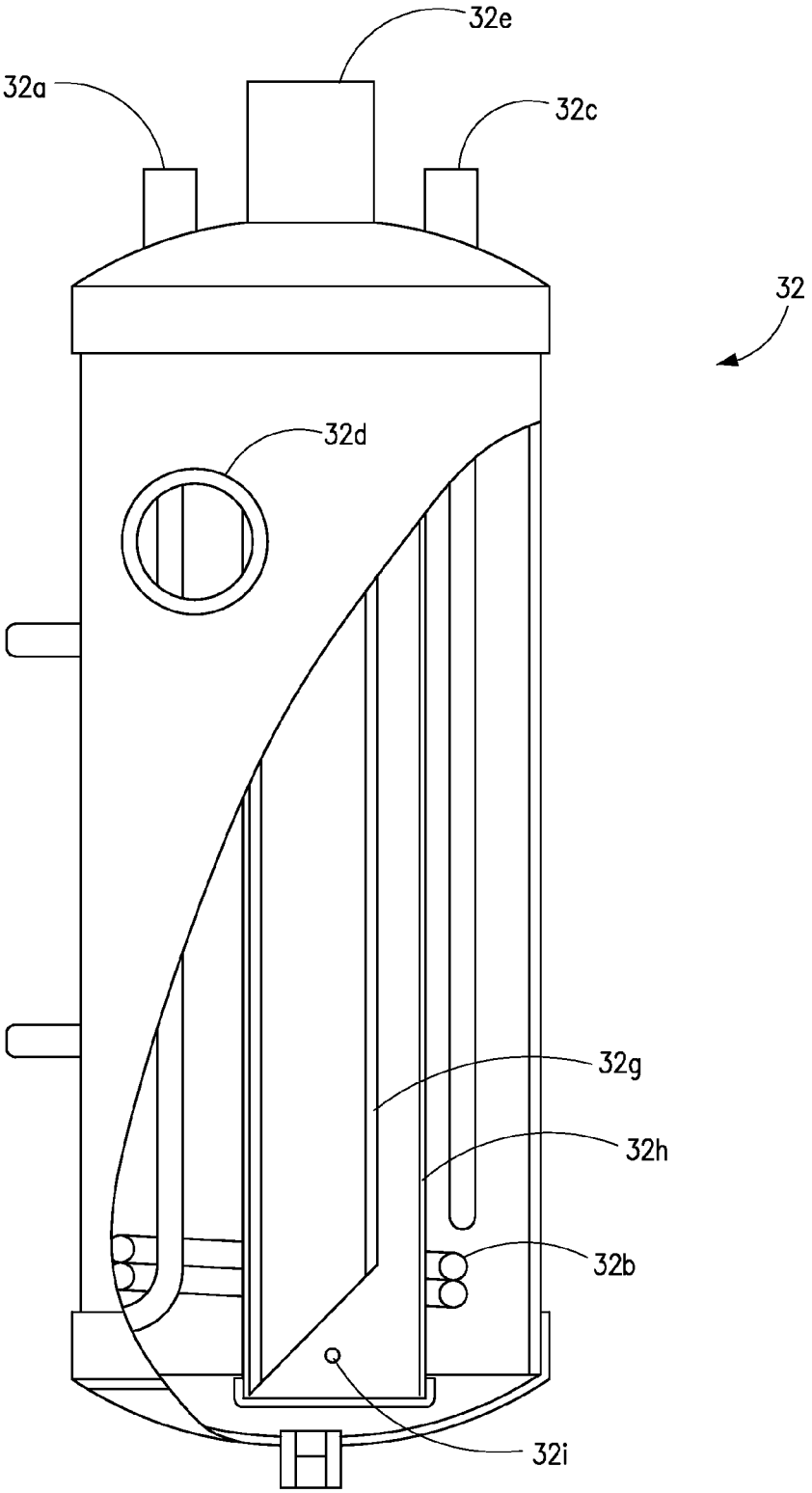
FIG. 3 is a schematic diagram of an ammonia accumulator for the modular ammonia chiller unit for the commercial refrigeration system of FIG. 2 according to an exemplary embodiment.

Referring further to FIGS. 2A-B and 3, the ammonia accumulator 32 is shown according to an exemplary embodiment. Ammonia accumulator 32 is not primarily intended for use as a receiver or ammonia storage tank or the like, but rather contains primarily ammonia vapor and serves as a suction line heat exchanger intended to return any liquid soluble oil that is carried-over from the evaporator 22 back to the compressor 24. According to an alternative embodiment, the accumulator 32 may not include suction line heat exchange capability, or such capability may be provided externally from the accumulator 32. Referring further to FIG. 3, the ammonia accumulator 32 includes a first inlet 32*a* for receiving condensed liquid ammonia from condenser 26, where it is then directed thorough a coil 32*b* and to a first outlet 32*c* for sending the liquid ammonia to the expansion device 28. Ammonia accumulator 32 also includes a second inlet 32*d* on a side of the accumulator 32 which opens to a shell-side of the accumulator 32 and through which ammonia refrigerant is received from the evaporator 22. The returning ammonia refrigerant and any entrained oil enter the shell-side of the accumulator 32, where any unabsorbed oil tends to accumulate proximate the bottom of the accumulator 32, and the vaporized ammonia refrigerant (and any absorbed soluble oil if applicable) tend to flow upwardly in the shell-side, then downwardly through first tube 32*g* and back up through second tube 32*h* for discharge through a second outlet 32*e* to the suction of the compressor 24. Any oil that has separated from the ammonia tends to accumulate in the bottom (e.g. sump, etc.) of the shell-side, or in the first tube 32*g* where it can drain to the bottom of the shell-side the accumulator 32 (e.g. through an aperture 32*i*, etc.) and may be reabsorbed (if soluble) in the ammonia vapor prior to returning to the compressor suction. If the oil is insoluble, the oil may be routed back to a sump portion of the compressor 24 (using appropriate valves and controls—such as a solenoid valve 32*f* operated by a signal from a level switch associated with the accumulator, etc.). The accumulator may also include a heater (e.g. insertion type heater, crankcase heater, belly and heater, etc.) in the bottom of the shell side (e.g. in the sump region) that is configured to energize while the compressor is "off" in order to further ensure any ammonia refrigerant entrained within the oil is vaporized for return to the suction of the compressor 24.

According to any preferred embodiment, a commercial cascade refrigeration system 10 is provided having an upper cascade portion 12 that includes one or more compact modular ammonia chiller units 20 that provide cooling to a lower portion 18 having a low temperature CO2 subsystem 60 and/or a medium temperature chilled liquid coolant subsystem 80, where the ammonia chiller units 20 use an oil (soluble or insoluble) for lubrication of a compressor, and in some embodiments an oil management system reduces oil carryover in the ammonia from the compressor and provides positive return of any accumulated oil from the evaporator 22 back to the compressor 24.

According to the illustrated embodiment of the present disclosure, the use of critically-charged compact modular ammonia chiller units 20 to provide cascade cooling to a low temperature CO2 refrigeration subsystem 60 and a medium temperature chilled liquid coolant (e.g. glycol-water, etc.) subsystem 80 results in an all-natural refrigerant solution for use in commercial refrigeration systems, such as supermarkets and other wholesale or retail food stores or the like, that entirely avoids the use of HFC refrigerants and provides an effective and easily maintainable "green" solution to the use of HFC's in the commercial refrigeration industry. The use of relatively small, critically-charged chiller units 20 permits a series of such modular low-charge devices to be combined as necessary in an upper cascade arrangement 12 in order to cool the load from a large lower refrigeration system 18 using a naturally occurring refrigerant. In addition to being HFC-free, the system as shown and described is intended to have near-zero direct carbon emissions, one of the lowest "total equivalent warming impact" (TEWI) possible, and is intended to be "future-proof" in the sense that it would not be subject to future rules or climate change legislation related to HFCs or carbon emissions.

Referring generally to FIGS. 1-4, any of a number of additional features may be included with the system according to various alternative embodiments. According to one example, the chiller units 20 may include one or more purge ports 42 connected downstream of relief valves 38 as a service feature, so that the various portions of the system may be purged to atmosphere simply by connecting such portion of the system (e.g. by suitable hoses, etc.) to the purge ports. Similarly, the chiller units 20 may include a dump valve 44 that can be programmed to manually or automatically vent the charge of ammonia refrigerant to atmosphere upon the initiation of a predetermined event (e.g. a leak of ammonia if the chiller unit is installed in an indoor or confined space, etc.) as may be required by local fire codes or the like. According to another example, any soluble oil that is accumulated in the evaporator 22 may be returned back through a line 46 to an upstream side of the expansion device 28 for reintroduction to the ammonia refrigerant according to the illustrated embodiment of FIG. 2A. Any oil accumulated in the evaporator 22 may also be returned back to the suction side of the accumulator 32 (e.g. via gravity, etc.) when the compressor 24 is turned off, according to the illustrated embodiment of FIG. 2B. According to yet another example, the evaporator 22 and condenser 26 of the chiller units 20 may be plate type heat exchangers that are nickel-brazed or all welded stainless steel. According to a further example, one or more heat reclaim devices (e.g. heat exchangers 48, etc.) may be disposed on (or otherwise communicate with) the compressor discharge piping upstream of the condenser to provide heat reclamation for any of a wide variety of heating loads associated with the facility, and also to de-superheat the hot gas ammonia vapor discharged from the compressor 24. According to yet another example, the capacity of the compact modular ammonia chiller units 20 as shown and described in the illustrated embodiments may be approximately 180 kBtu/Hr, and tends to be limited by the size of the plate-type heat exchangers; accordingly, chiller units of increased capacity may be obtained by increasing the size (or heat transfer capability) of the plate type heat exchangers used for the condenser and evaporator of the chiller unit. All such features and embodiments are intended to be within the scope of this disclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is important to note that the construction and arrangement of the elements of the refrigeration system provided herein are illustrative only. Although only a few exemplary embodiments of the present invention(s) have been described in detail in this disclosure, those skilled in the art who review this disclosure will readily appreciate that many modifications are possible in these embodiments (such as variations in features such as connecting structure, components, materials, sequences, capacities, shapes, dimensions, proportions and configurations of the modular elements of the system, without materially departing from the novel teachings and advantages of the invention(s). For example, any number of compact modular ammonia chiller units may be provided in parallel to cool the low temperature and/or medium temperature cases, or more subsystems may be included in the refrigeration system (e.g., a very cold subsystem or additional cold or medium subsystems). Further, it is readily apparent that variations and modifications of the refrigeration system and its components and elements may be provided in a wide variety of materials, types, shapes, sizes and performance characteristics. Accordingly, all such variations and modifications are intended to be within the scope of the invention(s).

What is claimed is:

1. A cascade refrigeration system, comprising:

a primary portion having at least one modular chiller unit, the primary portion being configured to provides cooling to at least one of a low temperature subsystem having a plurality of low temperature loads, and a medium temperature subsystem having a plurality of medium temperature loads;

the modular chiller unit comprising:

a refrigerant circuit having at least a compressor, a condenser, an expansion device, and an evaporator;

an ammonia refrigerant configured for circulation within the refrigerant circuit;

an ammonia refrigerant accumulator configured to transmit the ammonia refrigerant to the evaporator, to separately receive the ammonia refrigerant from the evaporator, and to receive the ammonia refrigerant from the condenser separate from the ammonia refrigerant received from the evaporator; and an oil management system downstream of the compressor and configured to remove oil from the ammonia refrigerant, the oil management system having an oil separator disposed between the compressor and the condenser, the oil separator configured to provide oil to an oil reservoir separate from the ammonia refrigerant accumulator, the oil reservoir coupled to the compressor via a pressure regulator, and an oil return line coupled to the evaporator and the ammonia refrigerant accumulator, the oil return line configured to receive oil returned from the evaporator and to provide the oil returned from the evaporator to the accumulator;

wherein the pressure regulator is configured to provide oil to the compressor from the oil reservoir to maintain a target pressure in the oil reservoir.

2. The cascade refrigeration system of claim 1, further comprising both the low temperature subsystem and the medium temperature subsystem, and wherein the low temperature subsystem comprises a CO2 refrigerant, and the medium temperature subsystem comprises a chilled liquid coolant comprising at least one of water and glycol, so that the cascade refrigeration system comprises only naturally-occurring refrigerants and environmentally safe coolants and is substantially HFC-free.

3. The cascade refrigeration system of claim 1, further comprising both the low temperature subsystem and the medium temperature subsystem, and wherein the low temperature subsystem comprises a CO2 refrigerant, and the medium temperature subsystem comprises a CO2 liquid coolant, so that the cascade refrigeration system comprises only naturally-occurring refrigerants and coolants and is substantially HFC-free.

4. The cascade refrigeration system of claim 1, wherein the compressor includes an oil, and a portion of the oil is entrained in the ammonia refrigerant, and wherein the accumulator is configured to receive the oil returned from the evaporator via the oil return line, and to direct the returned oil to the compressor.

5. The cascade refrigeration system of claim 4, wherein the oil comprises a PAO oil.

6. The cascade refrigeration system of claim 1, wherein the modular chiller unit contains a critical charge amount of the ammonia refrigerant and operates without an ammonia receiver tank.

7. The cascade refrigeration system of claim 1, further comprising a control device configured to start and stop the compressor, and to direct oil accumulated in the evaporator to return to the accumulator via the oil return line when the compressor is stopped.

8. The cascade refrigeration system of claim 4, wherein the oil return line is configured to route oil to the accumulator by gravity.

9. The cascade refrigeration system of claim 4, wherein the oil return line further comprises an oil pot configured to receive oil from the evaporator, the oil pot operably communicating with a heat source configured to vaporize ammonia entrained within the oil.

10. The cascade refrigeration system of claim 9, the oil return line further comprising an oil return valve having an open position and a closed position, and the compressor having an on position and an off position, wherein the oil return valve is configured to open when the compressor is in the off position to route oil from the oil pot to the accumulator.

11. The cascade refrigeration system of claim 1, further comprising an oil recycling circuit including an oil filter, the oil pressure regulator, and the oil reservoir;

wherein the oil separator is configured to separate the oil from the ammonia refrigerant; and wherein the oil recycling circuit is configured to route the oil from the oil separator through the oil filter, through the oil pressure regulator, and into the oil reservoir.

12. The cascade refrigeration system of claim 1, wherein the modular chiller unit comprises a plurality of modular chiller units arranged in a parallel configuration and packaged within a transportable enclosure configured for shipping and direct installation at a facility.

13. The cascade refrigeration system of claim 1, wherein the evaporator and condenser comprise plate heat exchangers formed at least partially from stainless steel.

14. The cascade refrigeration system of claim 1, wherein the condenser of the modular chiller unit comprises a water-cooled condenser that interfaces with a water coolant loop having one or more heat reclaim devices.

15. The cascade refrigeration system of claim 1, wherein the condenser of the modular chiller unit comprises an air-cooled microchannel condenser.

16. The cascade refrigeration system of claim 15, wherein the air-cooled microchannel condenser includes evaporative cooling.

* * * * *